United States Patent [19]

Foulke

[11] 3,932,145

[45] Jan. 13, 1976

[54] FUEL PREPARATION PROCESS

[76] Inventor: Willing B. Foulke, 109 Greenridge Road, Wilmington, Del. 19805

[22] Filed: May 3, 1973

[21] Appl. No.: 356,765

[52] U.S. Cl. ..... 44/1 R; 44/51; 44/6; 241/24

[51] Int. Cl.[2]..... C10L 1/32; B02C 7/00; C10L 9/00

[58] Field of Search..... 44/1 R, 1 B, 51, 6; 208/8; 201/17, 23; 241/24

[56] References Cited

UNITED STATES PATENTS

| | | | |
|---|---|---|---|
| 914,248 | 3/1909 | Damon | 44/10 F |
| 1,574,174 | 2/1926 | Schoch | 44/1 R |
| 1,925,005 | 8/1933 | Rose et al. | 44/1 B |
| 3,252,769 | 5/1966 | Nagelvoort | 44/1 R |
| 3,261,559 | 7/1966 | Yavorsky et al. | 241/24 |
| 3,733,183 | 5/1973 | Singh | 44/1 R |

*Primary Examiner*—Carl F. Dees

*Attorney, Agent, or Firm*—Smith, Harding, Earley & Follmer

[57] ABSTRACT

A fuel is produced by cleaning coal using an oil as a cleaning medium whereby the sulfur content of the fuel is substantially reduced and the heat content per pound is substantially increased by the reduction of water and other non-combustibles. The process may be used to produce a coal-oil fuel directly.

8 Claims, 1 Drawing Figure

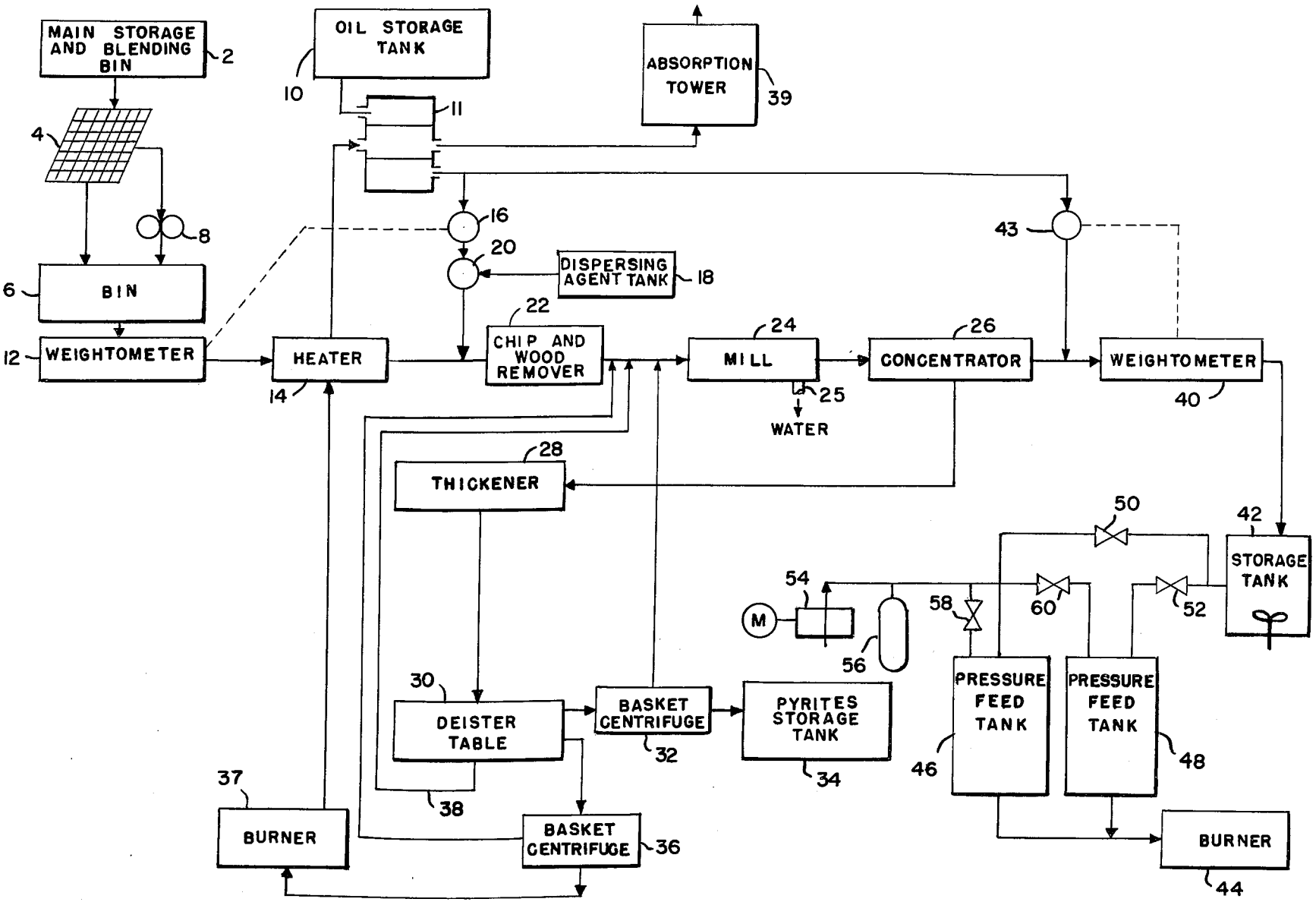
MAIN STORAGE AND BLENDING BIN
2
4
8
BIN
6
WEIGHTOMETER
12
HEATER
14
OIL STORAGE TANK
10
11
16
20
DISPERSING AGENT TANK
18
CHIP AND WOOD REMOVER
22
MILL
24
25
WATER
CONCENTRATOR
26
WEIGHTOMETER
40
43
ABSORPTION TOWER
39
THICKENER
28
DEISTER TABLE
30
38
BASKET CENTRIFUGE
32
BASKET CENTRIFUGE
36
BURNER
37
PYRITES STORAGE TANK
34
M
54
56
58
60
50
52
PRESSURE FEED TANK
46
PRESSURE FEED TANK
48
STORAGE TANK
42
BURNER
44

FUEL PREPARATION PROCESS

BRIEF SUMMARY OF THE INVENTION

This invention relates to fuel preparation processes, and particularly to a process for preparing a fuel consisting at least in part of coal which reduces the sulfur content of the combustion products and which increases the heat content per pound of fuel.

While coal is by far the most plentiful fossil fuel, its use in the electric power industry has recently become subject to objections which are difficult to overcome economically. Chief among these is the objection to sulfur dioxide in the combustion products of the coal because of its airpolluting character. The electric power industry accordingly has been required to purchase more expensive low-sulfur coal, and in some instances, plants have been forced to use products of petroleum as fuel rather than coal even though petroleum is much more expensive and less plentiful.

The principal object of this invention is to enable power plants to use coal as a fuel while satisfying strict air quality standards. In order to accomplish this object, the coal which is to be burned is passed through a cleaning apparatus in which oil is used as a cleaning medium. The sulfur content of coal is mostly in the form of iron pyrites ($FeS_2$) and gypsum ($CaSO_4 2H_2O$). That part of the sulfur content which is in the form of iron pyrites is greatly reduced by cleaning with oil. Even more importantly, however, the process of cleaning with oil eliminates the entrainment of water by the coal in the cleaning process and also removes some of the water which is inherently present in the coal. The elimination of entrainment and the removal of water greatly increases the heat content of the coal per unit weight.

The coal preparation process in accordance with the invention may be used to produce a coal-oil fuel consisting of coal particles suspended in oil. The coal-oil fuel has all of the advantages of ordinary fuel oil: low sulfur content, reduction of fly ash, elimination of the need for ash removal, and ease of handling. Furthermore, the treatment of coal using oil as a cleaning medium produces a fuel having a high efficiency in terms of cost per B.T.U. of heat generated. The invention is capable of use in producing a low-sulfur coal-oil fuel which is especially suitable for producing heat for electric power generation.

BRIEF DESCRIPTION OF THE DRAWING

The single FIGURE is a schematic diagram of an apparatus for producing and burning a coal-oil fuel, the apparatus being adapted for the preparation of fuel for use in an electric generating plant.

DETAILED DESCRIPTION

The plant shown in the drawing is designed to receive a low grade of coal and oil, and to convert the coal and oil into a coal-oil fuel with hot oil being used to effect removal of pyrite, water and other unwanted products from the coal.

Coal is stored in a main storage and blending bin 2. From bin 2, the coal is delivered to a vibrating screen 4 from which small particles are passed to a second storage bin 6. The large particles which are separated out by the screen are reduced by a pair of rolls 8 and then delivered to bin 6. The coal particles in bin 6 are thus more consistent with one another in size than those in main storage bin 2.

Oil is stored in tank 10. The oil may be any grade of petroleum oil, preferably having a low sulfur content. If desired, by reason of its availability, ordinary sludge of the kind obtained in the sulfuric acid refining of lubricating oil may be used. The sludge is preferably neutralized as by the process described in U.S. Pat. No. 2,309,633 which issued on Feb. 2, 1943 to F. I. Du Pont and myself. Further, the sludge is heated to reduce its viscosity to an extent making it suitable as a cleaning medium and may have other heated petroleum products added to reduce its viscosity further.

The oil which is delivered from the storage tank passes through a heat exchanger 11 so that the oil is maintained in a hot (preferably above the boiling point of water) condition.

Coal is delivered from bin 6 through a weightometer 12 to a heater 14 which raises the temperature of the coal prior to its introduction into the concentrator in order to prevent the heat of the oil from being utilized primarily to heat the coal rather than to remove water. The weightometer controls a proportioning valve 16 which controls the flow of oil from heat exchanger 11. If necessary to prevent agglomeration of small particles, dispersing agent stored in tank 18 may be added to the oil passing out of proportioning valve 16 by means of a proportioning valve 20 designed to maintain a substantially constant percentage of dispersing agent in the oil. The oil and coal are mixed together and fed into a chip and wood remover 22 and the mixture is delivered from the chip and wood remover to a mill 24 in which the coal particles are reduced in hot oil to the desired size for the concentrator 26. The chip and wood remover may also include magnetic iron removing means. The mill may be, for example, a rod mill, a ball mill, or a cylindro-conical mill, and is desirably jacketed in order to maintain the oil at a high temperature. A water outlet is provided at 25.

The mixture is delivered from the outlet of the mill to a concentrator 26 which effects cleaning of the coal. For the purpose of this application, a concentrator is any device which utilizes a liquid medium to accomplish separation of particles in which particles having a high specific gravity settle out of the liquid under the influence of gravity and particles of lower specific gravity are carried away from the settled particles by the liquid. A wide variety of concentrators may be used in accordance with the invention. For example, concentrators which utilize sliding friction such as Wilfley tables, Deister tables, or Vanners may be used. Similarly, devices which utilize primarily the properties of a liquid to effect gravity concentration may be used. Examples of the latter include launderers and rake classifiers, and concentrators of the hindered settling type. Hindered settling concentrators are preferred for use in the practice of this invention, and when so used are characterized by an upward current of hot oil which effect separation of coal particles from undesired components. The Fahrenwald classifier is an example of a suitable hindered settling concentrator. Surface current classifiers such as the Spitzkasten classifier and numerous other types of concentrators may also be used.

When used in the invention, all of the above processes utilize heated oil instead of the usual liquid medium. The oil is preferably heated to a temperature above the boiling point of water for the most effective removal of water from the coal being treated. However, oil at a temperature substantially above ambient will cause effective evaporation of water, the higher the temperature, the greater the evaporation. "Hot" and "heated" as used herein refer to temperatures above approximately 50°C.

Heavy particles, which include a large proportion of the pyrites content of the coal are removed by concentrator 26, and are delivered through thickener 28 to Deister table 30 which effects a further separation of pyrites from coal in the mixture which settled out in concentrator 26.

Pyrites which is separated out by table 30 is delivered along with oil to basket centrifuge 32, which effects a separation of oil from the pyrites, the oil being delivered to the inlet of mill 24, and the pyrites being delivered to a storage tank 34.

Refuse and oil are delivered from the table 30 to a second basket centrifuge 36 which partially separates oil and refuse, delivering the separated oil to the inlet of mill 24, and delivering the remaining oil and refuse to burner 37, the exhaust of which is used to operate heater 14 and heat exchanger 11. The exhaust is delivered to the atmosphere through a sulfur dioxide and nitrogen oxide absorption tower 39. A precipitator may be used if desired, to remove particulate matter.

Coal and oil separated out by table 30 are returned along path 38 to the inlet of mill 24.

A coal-oil mixture is delivered by concentrator 26 to a storage tank 42. Additional oil may be added by means of a proportioning valve 43 controlled by weightometer 40. The mixture in the storage tank is mechanically agitated in order to keep the coal particles in suspension.

A burner is indicated at 44, and it receives the coal-oil mixture from storage tank 42 through a pair of pressure feed tanks 46 and 48. The mixture in tank 42 is delivered to pressure feed tank 46 through valve 50 and to pressure feed tank 48 through valve 52. A compressor 54 is provided with an accumulator 56 and is arranged to deliver air to tanks 46 and 48 through valves 58 and 60 respectively and the four valves associated with the pressure feed tanks are operated automatically so that valves 52 and 58 are open while valves 50 and 60 are closed and valves 50 and 60 are open while valves 52 and 58 are closed. The valves are alternated between the above two conditions so that a constant flow of coal-oil fuel is delivered to burner 44.

The apparatus and process exemplified by FIG. 1 and the foregoing description produce a number of beneficial results.

In the first place, the invention provides a simple process for producing a coal-oil fuel having a low sulfur content. By using oil as a cleaning medium to clean raw coal which has been comminuted, the process of producing a coal-oil fuel is greatly simplified.

The second principal benefit afforded by the invention is the production of low sulfur fuel having a high efficiency in terms of cost per B.T.U. of heat generated. The greater efficiency of the fuel results partly from the fact that sulfur-containing compounds are separated from the coal without the addition of water to the coal. The low water content of the fuel means that the large quantity of heat which would otherwise be wasted in converting water in the coal to steam is available for useful purposes. The use of oil not only prevents cleaning water from entering the coal, but actually removes water from the coal which is residually present as a result of prior washing or as a result of natural causes. The removal of residual water is enhanced by the use of hot oil. In addition, the hot condition of the oil reduces its viscosity and therefore increases the effectiveness of the oil as a separation medium. The removal of residual water by the oil is further enhanced by the fact that the coal is reduced to a comminuted condition by mill 24.

Other subsidiary benefits of the apparatus and process disclosed above include the fact that the use of oil removes moisture from the comminuted coal without resulting in a dangerously explosive dry dust. Another benefit results from the use of refuse to produce heat used in the process. In addition, part or all of the refuse removed from basket centrifuge 36 may be treated by additional tabling to recover sulfur compounds which may then be used for manufacturing or agricultural purposes. In the event that the refuse is so treated, the residue from the treatment may be burned to provide heat for the overall process. The fuel produced by the process disclosed above is a very high B.T.U., low sulfur coal-oil fuel, an ideal fuel for power generation, particularly in view of the relatively innocuous characteristic of its combustion products and its low cost per available B.T.U. The process, of course, may be readily modified, by providing for the separation of oil from the coal particles to produce a high quality solid fuel having a low sulfur content and, because of the substantial absence of water, a very high heat content per unit weight.

Various modifications of the apparatus and process specifically disclosed herein may be made without departing from the scope of the invention which is defined in the following claims.

I claim:

1. The method of producing a low-sulfur fuel consisting essentially of coal particles suspended in an oil comprising the steps of:

a. introducing a mixture of coal particles, and undesired particles having a higher specific gravity than coal, into a concentrator;

b. introducing oil into the concentrator;

c. cleaning said mixture in the concentrator, using oil as the cleaning medium, by effecting settling of undesired particles; and d. removing from the concentrator a suspension of coal particles in oil for use as a fuel.

2. The method according to claim 1 in which the oil is brought into contact with the coal in a heated condition.

3. The method according to claim 1 in which the oil is brought into contact with the coal at a temperature above the boiling point of water.

4. The method according to claim 1 including the steps of removing refuse from the concentrator, separating heavy components from lighter components of said refuse, burning the lighter components, and using the heat generated in the burning step to heat the oil prior to its being brought into contact with the coal.

5. The method according to claim 1 including the steps of removing refuse from the concentrator, separating heavy components from lighter components of said refuse, burning the lighter components, and using the heat generated in the burning step to heat the coal prior to its introduction into the concentrator.

6. The method of claim 1 including the steps of removing the undesired particles from the concentrator along with oil, separating the oil so removed from the undesired particles, and returning the oil to the concentrator for use as a cleaning medium.

7. The method of claim 1 in which the mixture of coal particles and undesired particles is comminuted in the presence of oil prior to introduction of the mixture into the concentrator.

8. The method according to claim 1 in which the concentrator is a hindered settling concentrator.

* * * * *